US006331686B1

(12) United States Patent
Rogatschnig

(10) Patent No.: US 6,331,686 B1
(45) Date of Patent: Dec. 18, 2001

(54) APPARATUS HAVING A SWITCH WHICH IS OPERABLE VIA A DOME-SHAPED ELASTIC COVER

(75) Inventor: Johann Rogatschnig, Velden (AT)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/274,394

(22) Filed: Mar. 23, 1999

(30) Foreign Application Priority Data

Mar. 27, 1998 (EP) ..... 98890086

(51) Int. Cl.[7] ..... H01H 13/06

(52) U.S. Cl. ..... 200/302.2; 200/302.3; 200/552

(58) Field of Search ..... 200/302.2, 302.3, 200/43.01, 43.08, 513, 516, 552

(56) References Cited

U.S. PATENT DOCUMENTS 4,356,367 * 10/1982 Moldenhauer ..... 200/252 X
4,652,706 * 3/1987 Roa et al. ..... 200/302.2 X
4,924,046 * 5/1990 Howard ..... 200/516
5,725,086 * 3/1998 Cooper ..... 200/302.3

FOREIGN PATENT DOCUMENTS

0011320A2 5/1980 (EP) ..... H01H/13/04

* cited by examiner

*Primary Examiner*—Renee Luebke
(74) *Attorney, Agent, or Firm*—Ernestine C. Bartlett; Norman N. Spain

(57) ABSTRACT

In an apparatus comprising a housing wall formed with a passage closed by an elastically deformable cover which has a raised portion and comprising switching means arranged behind the cover, a switching function of the switching means can be actuated only when a raised portion is moved into an operating position in which the cover has a recessed shape in the area of the raised portion.

6 Claims, 4 Drawing Sheets

APPARATUS HAVING A SWITCH WHICH IS OPERABLE VIA A DOME-SHAPED ELASTIC COVER

BACKGROUND OF THE INVENTION

The invention relates to an apparatus comprising a housing having a housing wall formed with a passage closed by a cover connected to the housing wall, which cover is elastically deformable and has a portion which is raised with respect to the adjacent area of the housing wall in a rest position of the cover and owing to its elastic deformability, the raised portion of the cover is movable transversely to the housing wall in a direction toward the apparatus interior from a rest position into an operating position, and which has an actuating means which, when the raised portion is moved from its rest position into its operating position, is movable from an inactive position into an active position, and comprising switching means which are accommodated in the apparatus and by means of which, when the actuating means is moved from its inactive position into its active position, a switching function can be activated with the aid of the actuating means.

Such an apparatus of the type defined in the opening paragraph is known, for example from the document EP 0 011 320 A2. In the known apparatus a housing wall has a plurality of passages in the form of small holes and the cover is located in the interior of the apparatus, the cover having protrusions which extend through the passages in the housing wall, the free ends of the protrusions thus forming the raised portions of the cover. When in the known apparatus the raised portions of the cover, i.e. the free ends of the protrusions are brought into a position in which they are flush with the adjacent area of the housing wall, this activates a switching function of the switching means inside the apparatus, as a result of which the apparatus is, for example, switched on. The construction and the operation of this known apparatus have the drawback that, for example, by simply placing the apparatus onto a surface, the free ends of the protrusions of the cover can assume a position in which they are flush with the adjacent area of the housing wall, which may result in an inadvertent actuation of a switching function of the switching means, which is obviously undesirable. Such an inadvertent actuation of a switching function of the switching means of the apparatus may lead to, for example, an unwanted loading of the batteries used in such an apparatus, which results in undesired draining of these batteries.

SUMMARY OF THE INVENTION

It is an object of the invention to preclude the aforementioned problems and to provide an improved apparatus of the type defined in the opening paragraph. According to the invention, in order to achieve this object with such an apparatus, when the raised portion of the cover has been moved out of its rest position into a position flush with the adjacent area of the housing wall, the actuating means of the cover occupies an intermediate position situated between its inactive position and its active position, in which intermediate position an actuation of a switching function of the switching means with the aid of the actuating means is inhibited, and the raised portion of the cover is movable towards the apparatus interior out of its position in which it is flush with the adjacent area of the housing wall into an operating position in which the actuating means, which then occupies its active position, actuates a switching function of the switching means.

By means of the measures in accordance with the invention it is achieved in a very simple and also very reliable manner that an unintentional actuation of a switching function of the switching means of the apparatus is precluded or inhibited in a far more reliable manner than in the known apparatus mentioned in the introduction, primarily because for actually performing a switching function of the switching means the raised portion of the cover must be moved into an operating position which, with respect to a flush position relative to the adjacent area of the housing wall, are situated nearer the apparatus interior, which is possible almost only by deliberately actuating the raised portion by means of a finger, for example the thumb, of a hand. In preferred embodiments of the invention:

- the passage in the housing wall has a circular cross-section and the raised portion has a dome shape adapt to this circular cross-section; and/or
- the raised portion, which is dome-shaped, has an actuating means in the form of an actuating projection which projects from the dome interior of the raised portion; and/or
- the housing wall has a second passage having a second circular cross-section and a second raised portion has a dome shape adapted to the second circular cross-section and both raised portions, which each have a dome shape, belong to a single cover; and/or
- there are two dome-shaped raised portions as discussed hereinabove, and both dome-shaped raised portions each have an actuating means in the form of an actuating projection which projects from the respective raised portion into the dome interior; and/or
- the switch comprises a switch toggle having two switch arms and each of the two actuating projections provided as actuating means is constructed and arranged to cooperate with a switch arm of the switch toggle.

The above-mentioned as well as further aspects of the invention will become apparent from the example of an embodiment described hereinafter and will be elucidated with reference to this example.

BRIEF DESCRIPTION OF THE DRAWINGS

The invention will now be described in more detail with reference to an embodiment shown in the drawings and given by way of example, to which the invention is not limited.

DESCRIPTION OF THE PREFERRED EMBODIMENTS

Figure 1:
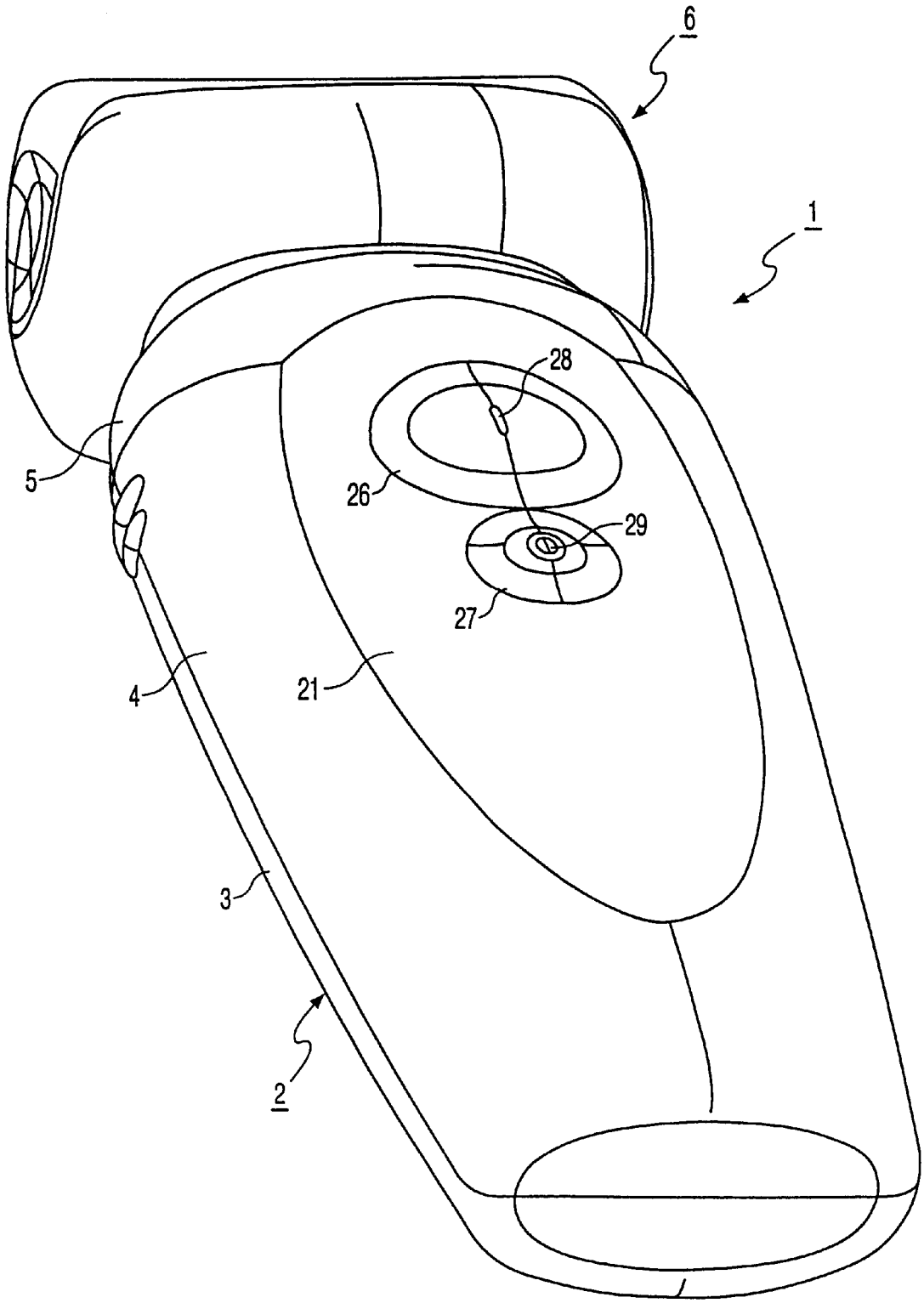
FIG. 1 is an oblique view of an apparatus in accordance with an embodiment of the invention, which is a wet-dry shaver comprising an elastic cover in the area of a housing wall, which cover has two dome-shaped raised portions.

FIG. 1 shows an apparatus 1, which is a so-called wet-dry shaver. The apparatus 1 has a housing 2 which essentially comprises two shell halves 3 and 4, which are connected to one another to form a one-piece shell. At one end of the housing 2 the shell is closed by an end portion 5. In the area of the end portion 5 a shaving head 6 projects from the housing 2, which comprises cutting means not shown in FIG. 1, for example a stationarily mounted shear foil and a reciprocatingly drivable lamellar cutter which cooperates with the shear foil.

The housing 2 accommodates a drive motor, not shown in FIG. 1, for driving the lamellar cutter. The housing 2 further accommodates two rechargeable batteries, not shown, for powering the drive motor. To switch on the apparatus 1, for which the batteries and electrically conductive connection to the drive motor is established, the apparatus 1 comprises switching means 7, as can be seen in FIGS. 2 to 4.

The switching means 7 comprise a switch toggle 9 which is pivotable about a pivot 8, which is shown diagrammatically. The switch toggle 9 comprises a first switch arm 10 and a second switch arm 11, which each have a recess 12 and 13, respectively. The switching means 7 further comprise a flexible contact spring 14 having an end portion 15 secured to an inner wall 16 of the apparatus 1. The switching means 7 further comprise a stationary contact 17, which is likewise connected to the inner wall 16. The contact spring 14 has a curved portion 18 with which it cooperates with the first switch arm 10, in such a manner that by a pivotal movement of the switch toggle 9 in the direction indicated by an arrow 19 the curved free end portion 20 of the contact spring 14 can be brought into electrically conductive engagement with the stationary contact 17.

Figure 2:
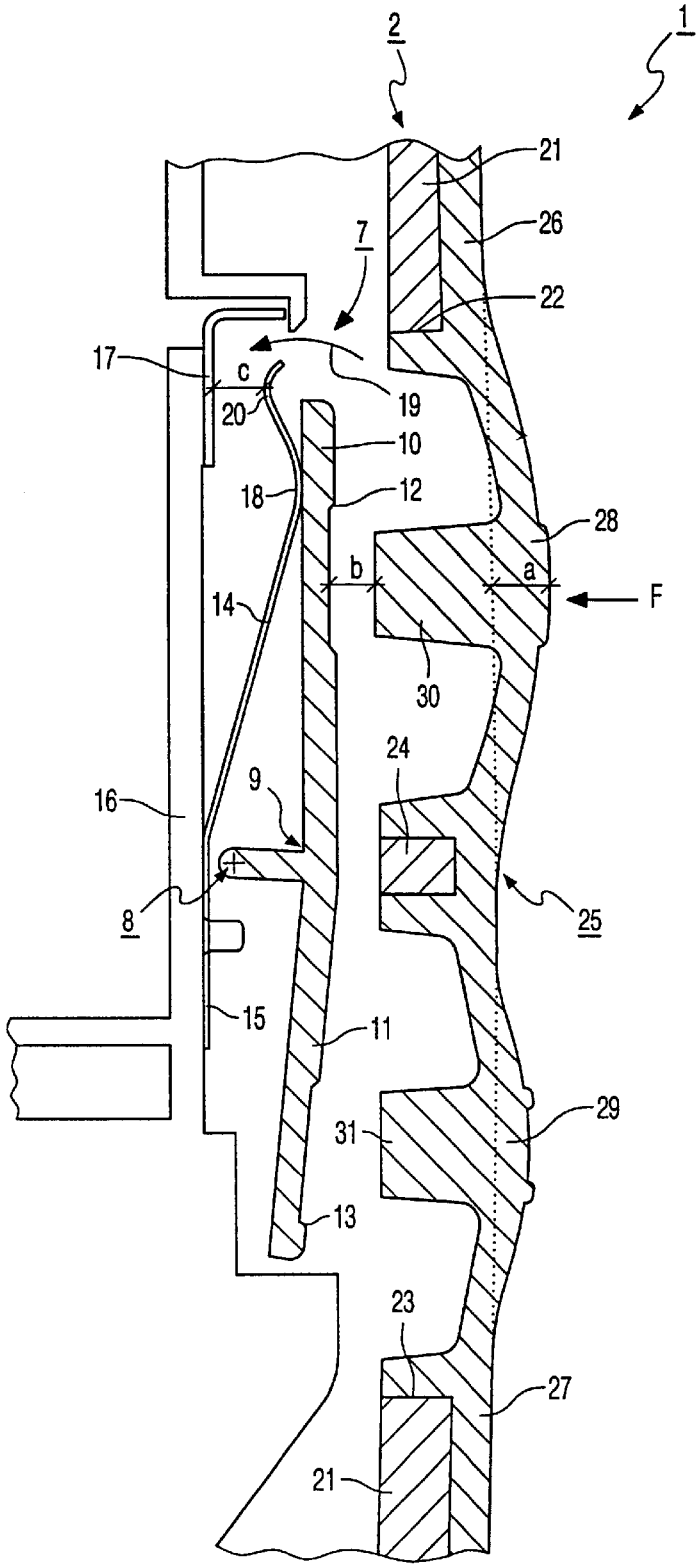
FIG. 2 shows a part of the apparatus of FIG. 1 in a longitudinal sectional view taken across the two raised portions of the cover of this apparatus, the two raised portions each being shown in a rest position and the switching means of the apparatus being shown in an off position.
Figure 3:
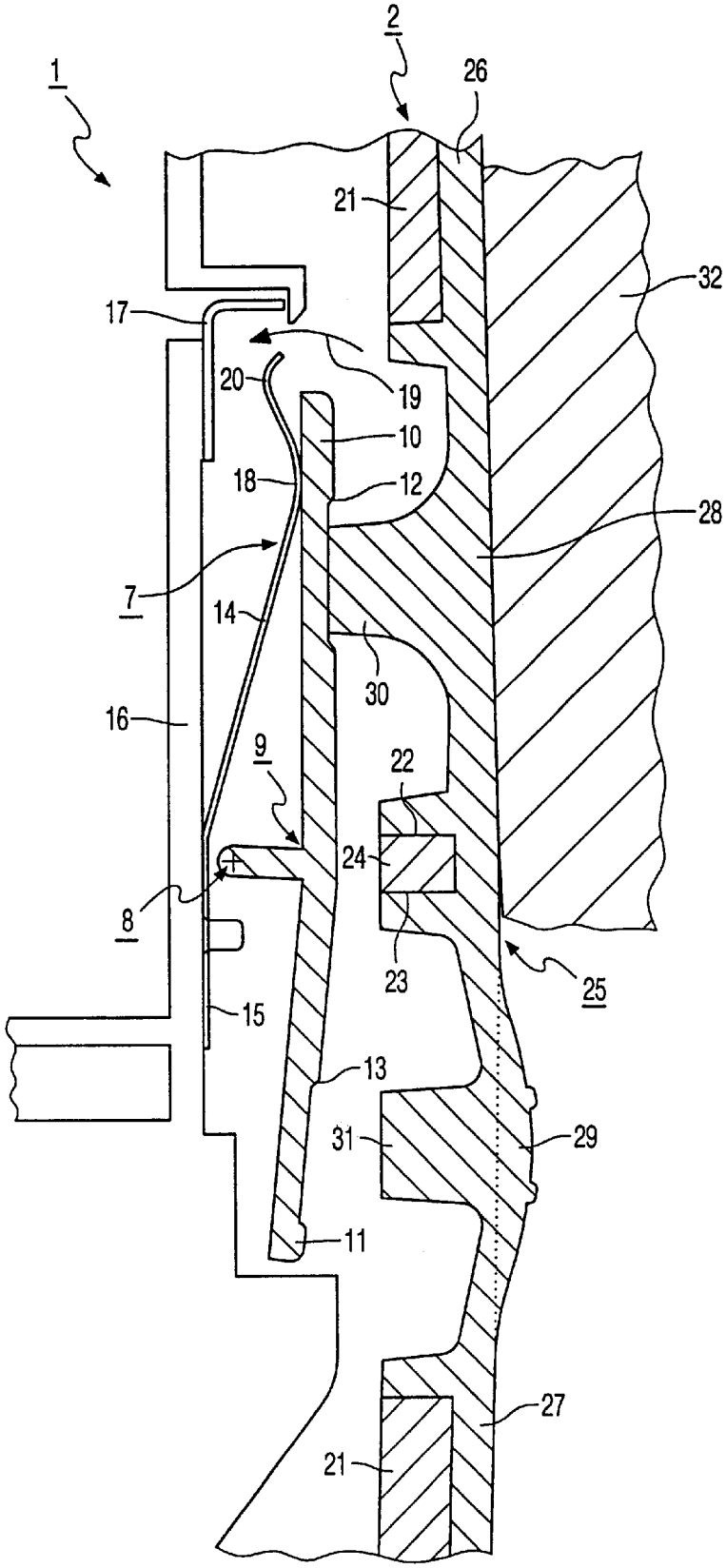
FIG. 3, similarly to FIG. 2, shows a part of the apparatus of FIG. 1, one raised portion being shown in a position flush with the adjacent area of the housing wall and the switching means being shown in their off position.

FIGS. 2 and 3 show the switching means 7 in their off position, in which the free end portion of the contact spring 14 is disengaged from the stationary contact 17 and the curved portion of the contact spring 14 engages against the first switch arm 10 of the switch toggle 9, which is then disengageably held in a position corresponding to the off position of the switching means 7 with the aid of means, not shown. These means are formed by, for example, latching means. FIG. 4 shows the switching means 7 in their on position, in which the switch toggle 9 occupies a position in which it has been moved in a direction indicated by the arrow 19 and in which it is disengageably held with the aid of means, not shown. These means can also be formed by, for example, latching means. In the on position of the switching means 7 the contact spring 14 is held in a position in which it has been moved in the direction indicated by the arrow 19 with the aid of the first switch arm 10 of the switch toggle 9, the curved free end portion 20 of the contact spring 14 being in electrically conductive engagement with the stationary contact 17.

Figure 4:
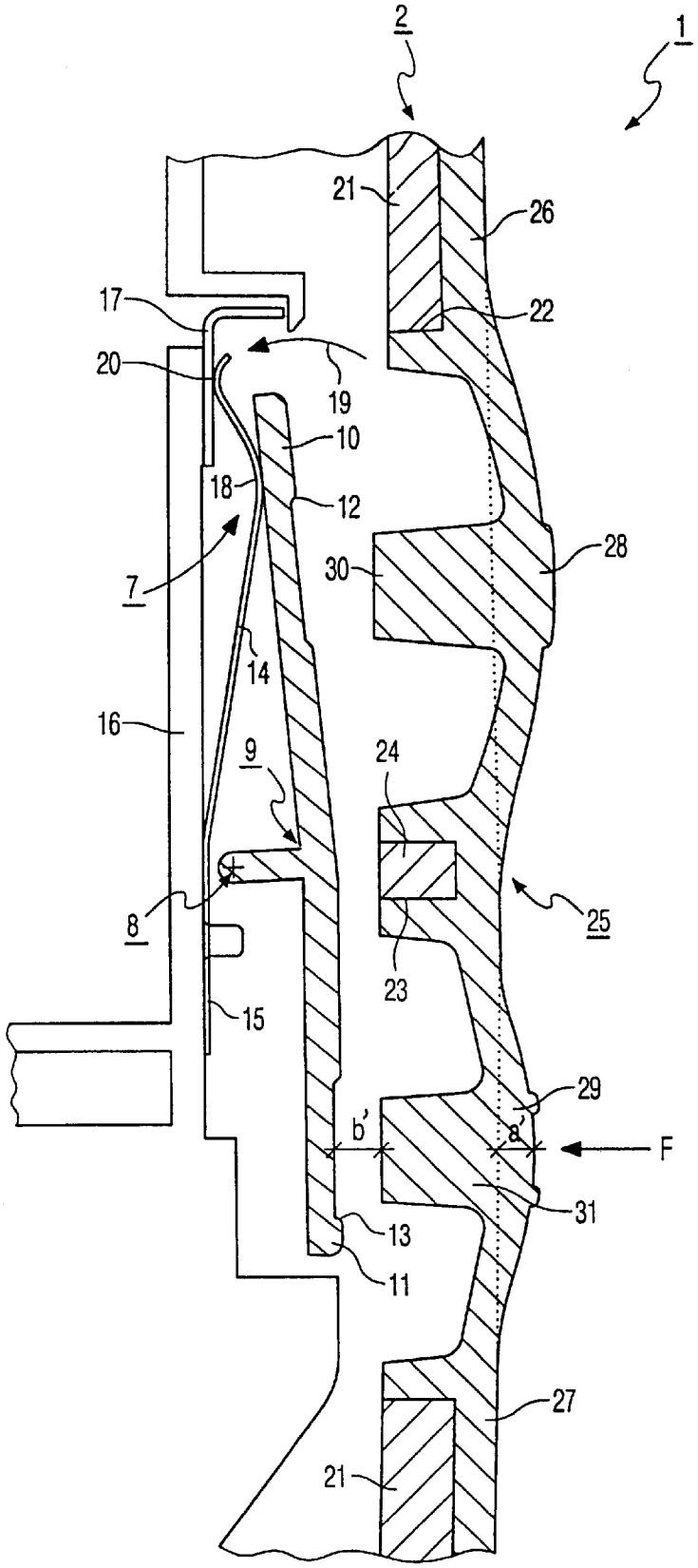
FIG. 4, similarly to FIGS. 2 and 3, shows a part of the apparatus of FIG. 1, both raised portions being shown in their rest positions and the switching means being shown in their on position.

The housing 2 of the apparatus 1 has, in addition to other housing walls, a housing wall 21, which is shown in sectional view in FIGS. 2, 3 and 4. The housing wall 21 has a first passage 22 and a second passage 23. The first passage 22 has a first circular cross-section. The second passage 23 has a second circular cross-section. The two passages 22 and 23 are formed in the housing wall 21 directly adjacent one another and are only separated from one another by a portion 24 of the housing wall 21, which portion substantially has the shape of a double wedge.

To close the two passages 22 and 23 the apparatus 1 has a cover 25 made of an elastically deformable plastic and formed in a so-called molding-on process, in which a mechanically stable and liquid-tight joint is obtained. As a result of the use of an elastically deformable plastic the cover 25 is elastically deformable.

In the present case, the cover 25 has a first portion 28 which is raised with respect to the adjacent area of the housing wall 21 in a rest position of the cover 25 and a second portion 29 which is raised with respect to the adjacent area of the housing wall 21 in a rest position of the cover 25. Owing to its elastic deformability each raised portion 28 or 29 of the cover 25 is movable transversely to the housing wall 21 in a direction toward the apparatus interior from a rest position shown in FIGS. 1, 2 and 4 into an operating position.

The first raised portion 28 has a dome-shape adapted to the first circular cross-section of the first passage 22. The second raised portion 29 has a dome-shape adapted to the second circular cross-section of the second passage 23.

The cover 25 has an actuating means 30 and 31, respectively, for each of the raised portions 28 and 29, i.e. a first actuating means 30 associated with the first raised portion 28 and a second actuating means 31 associated with the second raised portion 29. As can be seen in FIGS. 2 to 4, each dome-shaped raised portion 28 and 29 has an actuating means 30 or 31 in the form of an actuating projection which projects into the dome interior from the respective raised portion 28 or 29. Each of the two actuating projections forming the actuating means 30 and 31 is constructed and arranged to cooperate with a respective switch arm 10 or 11 of the switch toggle 9. The actuating means 30 and 31 are constructed and arranged to cooperate with the recesses 12 and 13 in the switch arms 10 and 11, which guarantees a reliable cooperation.

When the raised portion 28 or 29 is moved from its rest position into its operating position each actuating means 30 or 31 is movable from an inactive position shown in FIGS. 2 and 4 into an active position, not shown in the Figures. When one of the two actuating means 30 and 31 is moved from its inactive position into its active position a switching function can be activated in the switching means 7 with the aid of the respective actuating means 30 or 31. By a movement of the first raised portion 28 from its rest position into its operating position and by the resulting movement of the first actuating means 30 from its inactive position into its active position the switch toggle 9 of the switching means 7 is movable into its position shown in FIG. 4, as a result of which the switching means 7 assume their on position, in which the contact spring 14 is in electrically conductive engagement with the stationary contact 17 and the apparatus 1 is consequently switched on. By a movement of the second raised portion 29 from its rest position into its operating position and by the resulting movement of the second actuating means 31 from its inactive position into its active position the switch toggle 9 of the switching means 7 is movable into its position shown in FIGS. 2 and 3, upon which the switching means 7 assume their off position, in which the contact spring 14 is disengaged from the stationary contact 17 and the apparatus 1 is consequently switched off.

According to the invention, the construction of the apparatus 1 is such that, when the raised portion 28 or 29 of the cover 25 has been moved out of its rest position into a position flush with the adjacent area of the housing wall 21, the respective actuating means 30 or 31 of the cover 25 occupies an intermediate position situated between its inactive position and its active position, in which intermediate position an actuation of a switching function of the switching means 7 with the aid of the actuating means 30 and 31 is inhibited, as is illustrated in FIG. 3 for the first actuating means 30 which is movable by means of the first raised portion 28, which Figure by way of illustration shows a wall 32 which holds the first raised portion 28 in its flush position. Each of the raised portions 28 and 29 of the cover is movable towards the apparatus interior in a direction indicated by an arrow F, out of its position in which it is flush with the adjacent area of the housing wall 21 into an operating position, not show in the Figures, in which the actuating means 30 or 31, which then occupies its active position, actuates a switching function of the switching means 7.

An excursion a of the first raised portion 28, a distance b between the first actuating means 30 and the first switch arm 10 of the switch toggle 9, and a distance c between the free end 20 of the contact spring 14 and the stationary contact 17 are indicated in FIG. 2. In the apparatus 1 the construction is such that the excursion a is smaller than the sum of the distances b and c, which ensures that when the first raised portion 28 has been moved out of its rest position into a position in which it is flush with the adjacent area of the housing wall 21 the first actuating means 30 does not actuate a switching function of the switching means 7. Likewise, an excursion for the second raised portion 29 and a distance b between the second actuating means 31 and the second switch arm 11 of the switch toggle 9 are given in FIG. 4. In the apparatus 1 the construction is such that the excursion a is selected to be smaller than the distance b, which ensures that when the second raised portion 29 has been moved out of its rest position into a position in which it is flush with the adjacent area of the housing wall 21 the second actuating means 29 does not actuate a switching function of the switching means 7.

In the apparatus described hereinbefore an unintentional actuation of a switching function of the switching means 7 of the apparatus 1 is inhibited with a comparatively high reliability because in order to achieve that a switching function of the switching means 7 is actually actuated the respective raised portion 28 or 29 of the cover 25 must be moved into an operating position which, with respect to a flush position relative to the adjacent area of the housing wall 21, is situated nearer the apparatus interior, as a result of which the cover should have a recessed shaped in the area of the respective raised portion 28 or 29 which is moved into its operating position, which is possible almost only by deliberately actuating the respective raised portion 28 or 29 by means of a finger, for example the thumb, of a hand.

The invention is not limited to the apparatus in accordance with the embodiment described hereinbefore by way of example. For example, an apparatus in accordance with the invention may comprise a cover having only on raised portion by means of which a switch can be changed over or actuated and which upon actuation effects switching on and upon a subsequent actuation effects switching off.

What is claimed is:

1. An apparatus comprising:

a housing having a housing wall formed with a passage;

a cover closing said passage and connected to the housing wall, which cover is elastically deformable and has a portion which is raised with respect to an adjacent area of the housing wall in a rest position of the cover, the raised portion of the cover being movable transversely to the housing wall in a direction toward the apparatus interior from a rest position into an operating position, and which has an actuator which, when the raised portion is moved from its rest position into its operating position, is moved from an inactive position into an active position, a switching system which includes a switch which is accommodated in the apparatus and by means of which, when the actuator is moved from its inactive position into its active position, a switching function is activated, wherein when the raised portion of the cover has been moved out of its rest position into a position flush with the adjacent area of the housing wall, the actuator of the cover occupies an intermediate position situated between its inactive position and its active position, in which intermediate position an actuation of a switching function of the switch with the aid of the actuator is avoided, and the raised portion of the cover is movable towards the apparatus interior out of its position in which it is flush with the adjacent area of the housing wall into an operating position in which the actuator actuates the switch.

2. An apparatus as claimed in claim 1, wherein the passage in the housing wall has a circular cross-section and the raised portion has a dome shape adapted to this circular cross-section.

3. An apparatus as claimed in claim 2, wherein the raised portion, which is dome-shaped, has an actuator in the form of an actuating projection which projects from the dome interior of the raised portion.

4. An apparatus as claimed in claim 2, wherein the housing wall has a second passage having a second circular cross-section, a second raised portion has a dome shape adapted to the second circular cross-section and both raised portions, which each have a dome shape, belong to a single cover.

5. An apparatus as claimed in claim 4, wherein both dome-shaped raised portions each have an actuator in the form of an actuating projection which projects from the respective raised portion into the dome interior.

6. An apparatus as claimed in claim 5, wherein the switch comprises a switch toggle having two switch arms and each of the two actuating projections provided as actuating means is constructed and arranged to cooperate with a switch arm of the switch toggle.

* * * * *